United States Patent [19]

Sakraida, Jr.

[11] 4,391,312

[45] Jul. 5, 1983

[54] LOG SPLITTING HEAD

[76] Inventor: Gerard J. Sakraida, Jr., R.D. #2, Douglas Rd., Beaver Falls, Pa. 15010

[21] Appl. No.: 268,783

[22] Filed: Jun. 1, 1981

[51] Int. Cl.[3] ..... B27L 7/00

[52] U.S. Cl. ..... 144/193 E; 144/193 A

[58] Field of Search ..... 144/193 R, 193 A, 193 E

[56] References Cited

U.S. PATENT DOCUMENTS

| | | | |
|---|---|---|---|
| 4,103,724 | 8/1978 | Braid | 144/193 E |
| 4,112,985 | 9/1978 | Gosselin | 144/193 A |
| 4,337,809 | 7/1982 | Bertolette et al. | 144/3 K |

FOREIGN PATENT DOCUMENTS

| | | | |
|---|---|---|---|
| 578067 | 6/1959 | Canada | 144/193 A |

*Primary Examiner*—W. D. Bray

*Attorney, Agent, or Firm*—Webb, Burden, Robinson & Webb

[57] ABSTRACT

A log splitting head comprising a baseplate, first and second vertical cutting plates opposed and spaced from each other and mounted to and perpendicular with the baseplate, each including a cutting edge, a horizontal cutting plate mounted to and supported by the first and second cutting plates, and also including a cutting edge, and means for securing the baseplate to the main frame of a log splitting machine.

16 Claims, 19 Drawing Figures

LOG SPLITTING HEAD

BACKGROUND OF THE INVENTION (1) Field of the Invention

This invention pertains to log splitting devices and more particularly to a log splitting head which may be attached to the main frame of a log splitting machine.

(2) Description of the Prior Art

With the onset of the present energy crisis, many people are utilizing wood as an alternate energy source. The wood is burned in fireplaces or in a variety of wood burning stoves to generate heat. For ease of placing the wood in the stove or fireplace and for a constant burn, it is desirable that the wood used be of uniform size. Prior log splitting heads do not produce wood with this desired uniformity.

Many devices have been used in the past for splitting logs. The most common is the standard wedge which is driven into a log by a sledgehammer and splits the log in two. Variations on the standard wedge have been made which split the log into more than two pieces. See, for example, U.S. Pat. No. 4,209,046.

When splitting large numbers of logs, it is quite common to use a log splitting machine with a power actuated ram. The log to be split is placed in the machine and the ram forces the log up against a splitting wedge or splitting head. U.S. Pat. Nos. 3,862,651; 4,157,105; 4,176,696 and 4,236,556 are exemplary of such machines. Often these machines have a fixed head permanently mounted to the machine and provide for only splitting the logs in half. In U.S. Pat. No. 4,157,105, the splitting head may be enlarged to split various sized logs in half.

The head in U.S. Pat. No. 3,802,651 includes a vertical cutting wedge as well as a horizontal cutting wedge. With this head, a log may be split into quarters with one pass through the head. Also, the horizontal cutting wedge is hydraulically adjustable to accommodate logs of varying diameter. However, the size of the quartered logs will not be uniform but will vary directly with the size of the initial log. Further, this head is permanently attached to the log splitting machine and requires a hydraulic system to adjust the horizontal wedge and thus handle different sized logs. U.S. Pat. No. 4,176,696 shows a similar head.

Accordingly, it is an object of the present invention to provide a log splitting head which can be used in combination with a power actuated ram.

It is a further object of the present invention to provide a log splitting head which can accommodate logs of varying size with minimal moving parts and which provides for simultaneous multiple splits.

It is yet another object of the present invention to provide a log splitting head which splits logs into sections which are especially uniform and neat regardless of the initial size of the log.

SUMMARY OF THE INVENTION

I have invented a log splitting head comprising a baseplate, first and second vertical cutting plates opposed and spaced from each other and mounted to and perpendicular with the baseplate, each including a cutting edge, a horizontal cutting plate mounted to and supported by the first and second cutting plates, and also including a cutting edge, and means for securing the baseplate to the main frame of a log splitting machine. Preferably the horizontal edge leads the vertical cutting edges, the baseplate has a beveled edge, the horizontal cutting plate slopes upward and away from its cutting edge, and the distance between the vertical cutting plates increases as the distance from their cutting edges increases. The horizontal cutting plate may be detachably mounted to the vertical cutting plates. I have also invented the above log splitting head in combination with a log splitting machine.

DESCRIPTION OF THE PREFERRED EMBODIMENTS

Figure 1:
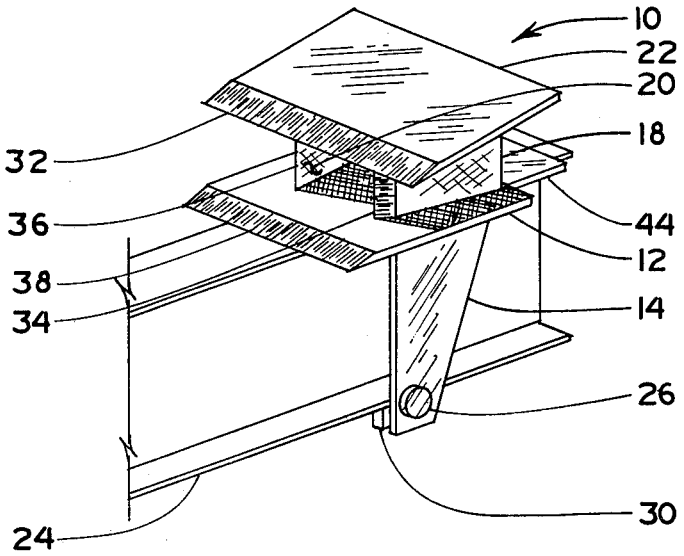
FIG. 1 is a perspective view of the log splitting head attached to the main frame of a log splitting machine.

Referring now to FIGS. 1–4, there is shown a log splitting head 10 in accordance with the present invention. The log splitting head 10 includes a baseplate 12, first and second support plates 14, 16 each mounted along one edge to one planar surface of the baseplate 12, first and second vertical cutting plates 18, 20 each mounted along one edge to the other planar surface of the baseplate 12, and a horizontal cutting plate 22 mounted to and supported by first and second vertical cutting plates 18, 20. The vertical cutting plates 18, 20 are opposed and spaced apart from each other and are oriented substantially perpendicular with, but set back from, the front edge 38 of the baseplate 12. The support plates 14, 16 are mounted perpendicular to the other planar surface of the baseplate 12, are parallel with each other and are spaced apart a sufficient distance to accommodate the log splitting machine main frame 24 upon which the log splitting head 10 is mounted.

The support plates 14, 16 are secured to the main frame 24 by means of a removable pin 26 which passes between the support plates 14, 16 immediately beneath the main frame 24. The pin 26 is held in place by a retainer 28 such as a cotter pin or the like. One or more blocks 30 may be mounted on the main frame 24 between the support plates 14, 16. These blocks 30 have holes to accommodate the pin 26 and provide additional support and stability for the log splitting head 10 when mounted.

The front edge of the horizontal cutting plate 22 is beveled to provide a sharp horizontal cutting edge 32. Similarly, the front edges of the vertical cutting plates 18, 20 are beveled to provide sharp first and second vertical cutting edges 34, 36. Because the logs to be split move along the surface of the main frame 24, the front edge 38 of the baseplate 12 is beveled to allow a log to slide freely up to the horizontal and vertical cutting plates 18, 20, 22 without catching. All of the cutting plates are oriented with their cutting edges facing the front edge 38 of the baseplate 12 and in cross section resemble the shape of the Greek letter "pi".

Figure 2:
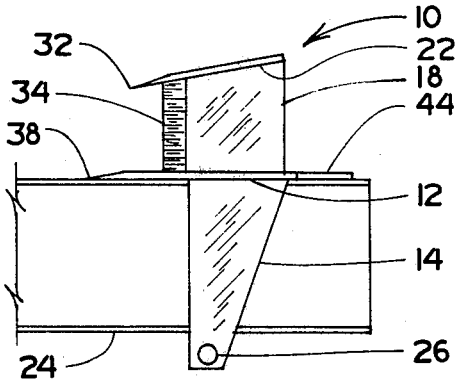
FIG. 2 is a side view of the log splitting head of FIG. 1.
Figure 3:
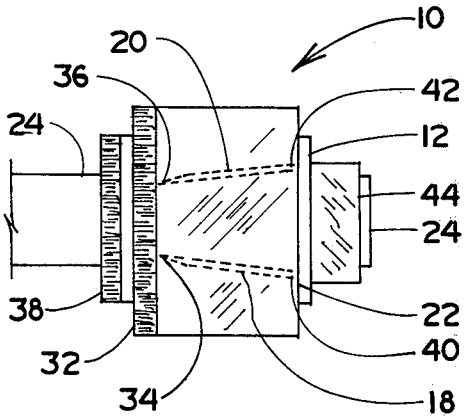
FIG. 3 is a top view of the log splitting head of FIG. 1.
Figure 4:
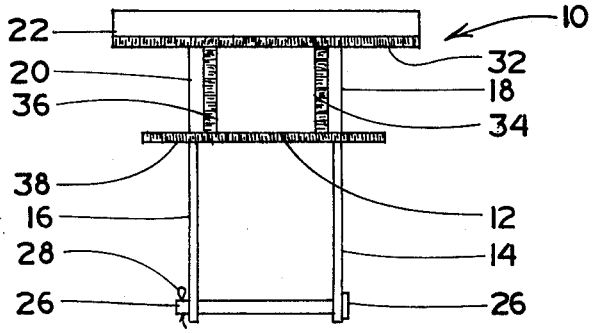
FIG. 4 is a front view of the log splitting head.

As is shown in FIGS. 2 and 3, the horizontal cutting edge 32 is set back behind the beveled front edge 38 of the baseplate 12. Further, the horizontal cutting edge 32 leads the vertical cutting edges 34, 36, i.e., the cutting edges 34, 36 of the vertical cutting plates 18, 20 are set back behind the cutting edge 32 of the horizontal cutting plate 22. In this manner, the log is split not all at once, but in successive stages—the horizontal split is made first and then the vertical split. By this arrangement less power is needed to force a log against the head 10 than would be needed if the cutting edges of the cutting plates were all on the same line, thus enabling a smaller log splitting machine to perform comparably to larger machines with less efficient splitting heads. It is to be understood that the cutting edges may be arranged in a variety of positions but preferably they are staggered to provide log splits in successive stages.

The horizontal cutting plate 22 is preferably inclined along an upward slope away from the horizontal cutting edge 32 with the cutting edge 32 being at the lowest level. The vertical cutting plates 18, 20 preferably diverge, while remaining perpendicular to the baseplate 12, providing for an increasing distance between the plates 18, 20 from their cutting edges 34, 36 to their rear edges 40, 42. In this manner, a split portion of a log passing between the vertical cutting plates 18, 20 will not touch the surface of either the vertical or the horizontal cutting plates. The remaining portions of the split log passing beneath the horizontal cutting plate 22 will pass along the vertical cutting plates 18, 20, but will not touch the horizontal cutting plate 22 once the cut has been made. In this manner frictional drag is substantially reduced, further reducing the necessary power from the log splitting machine. Also, the log will not become wedged within the splitting head 10 and the possibility of damage to the cutting plates from excessive pressure from the log is reduced or eliminated.

The log splitting head 10 of the present invention is easily mounted onto the main frame 24 of a log splitting machine. The pin 26 is removed from the support plates 14, 16, the head 10 is placed on the main frame 24 with the support plates 14, 16 straddling the main frame 24 and the baseplate 12 resting on the main frame 24, and the pin 26 is reinserted through the support plates 14, 16, the blocks 30 and retained with the retainer 28. To prevent backward movement of the log splitting head 10, a thrust plate 44 may be secured to the main frame 24 immediately adjacent the baseplate 12 by welding or the like.

Preferably the support plates 14, 16, baseplate 12, the vertical cutting plates 18, 20 and the horizontal cutting plate 22 are made of steel and are fastened together by welding or the like. However, as an alternate embodiment shown in FIG. 5, the horizontal cutting plate 22 may be detachably mounted to the vertical cutting plates 18, 20 by bolts 19 and nuts 21, or the like, and removed in the event of jamming of cut logs between the vertical cutting edges 34, 36. A wedge-shaped section 23 with openings 25 for the bolts 19 and nuts 21 may be mounted to the top of the horizontal cutting plate 22. This section 23 removes interference from the protrusion of the bolts 19 and nuts 21 and provides for a greater incline along the horizontal cutting plate 22.

Figure 5:
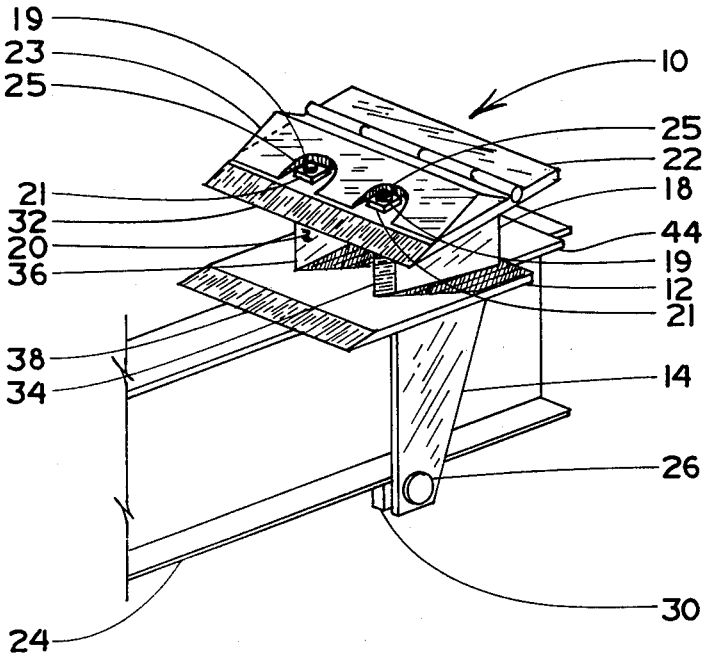
FIG. 5 is a perspective view of an alternate embodiment of the log splitting head attached to the main frame of the log splitting machine.

The horizontal cutting plate 22 shown in FIG. 5 can also be detached automatically by using nuts 21 made of soft aluminum. Such nuts 21 will shear off of the bolts 19 in the event that upward forces on the horizontal cutting plate 22 need to be dissipated. Alternately, shear pins may be used instead of the soft aluminum nuts. Also, stiff springs may be used to secure the horizontal cutting plate 22 to the vertical cutting plates 18, 20.

Figure 6:
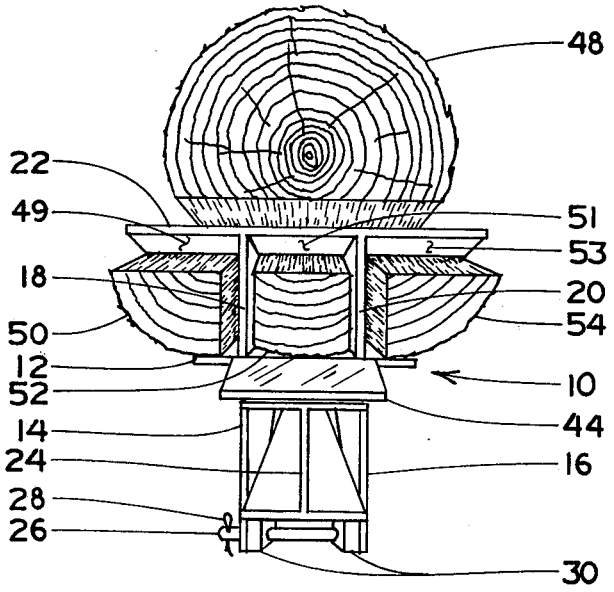
FIG. 6 is an end view of the log splitting head splitting a piece of wood.
Figure 7:
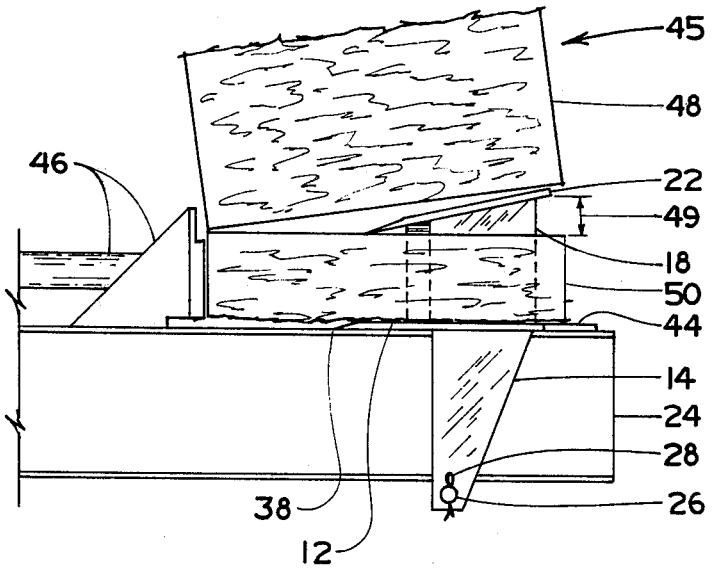
FIG. 7 is a side view of the log splitting head of FIG. 6.

The operation of the log splitting head 10 in splitting a typical log 45 is illustrated in FIGS. 6 and 7. The log 45 is moved along the main frame 24 and forced up against the log splitting head 10 by a power actuated ram 46. The log moves up the front edge 38 of the baseplate 12 and makes contact with the cutting edge 32 of the horizontal cutting plate 22 which begins splitting the log in two. The upper portion 48 of the log continues to move on top of the horizontal cutting plate 22. The lower portion of the log then makes contact with the cutting edges 34, 36 of the vertical cutting plates 18, 20 which split this portion into three smaller sections 50, 52, 54. The ram 40 continues to move the log until it is split along its entire length and the smaller sections 50, 52, 54 are removed. The ram is then retracted, the upper portion 48 of the log moved back down the horizontal cutting plate 22 and onto the main frame 24, and the splitting process is repeated.

It can be seen in FIGS. 6 and 7 that the lower portion of the log 50, 52, 54 does not further touch the horizontal cutting plate 22 once the horizontal split has been made. A series of spaces 49, 51, 53 are formed by the inclined slope of the horizontal cutting plate 22. Further, as can be appreciated in FIG. 6, the middle portion 52 of the lower portion of the split log does not make any contact with the vertical cutting plates 18, 20 once the vertical splits have been made and will not become jammed in this area. FIG. 6 also shows the blocks 30 secured against the bottom of the main frame 24.

FIGS. 8–12 illustrate schematically how various sized logs may be split into uniform sections using one size of a log splitting head 10 made in accordance with the present invention with one or more passes through the head 10 as is needed. Each of these drawings includes, for purposes of clarity, only the baseplate 12, vertical cutting plates 18, 20 and horizontal cutting plate 22 of the log splitting head 10, as well as the log to be split. While the logs are shown in circular cross section, it is to be appreciated that wood of any cross section may be advantageously split using tthe log splitting head 10 of the present invention.

Figure 8:
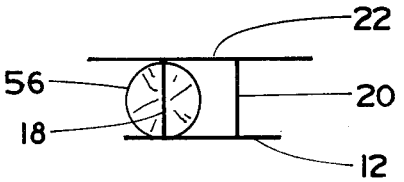
FIG. 8 is a schematic illustration of how a small log would be split by the log splitting head.
Figure 9:
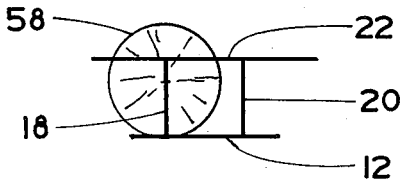
FIG. 9 is a schematic illustration of how a larger log would be split by the log splitting head in one pass.
Figure 10A:
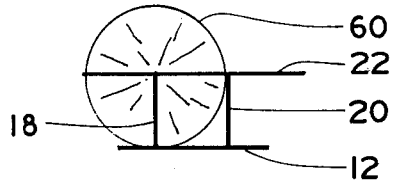
FIGS. 10A and B are sequential schematic illustrations of how a larger log would be split by the log splitting head in two passes.
Figure 10B:
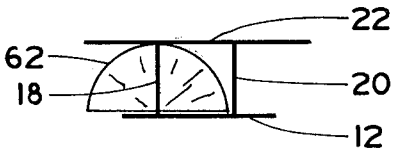
Figure 11A:
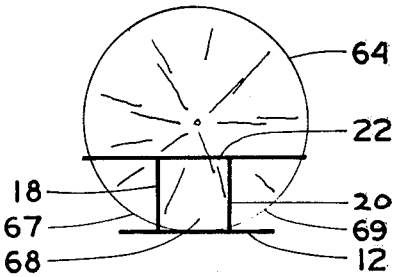
FIGS. 11A, B, and C are sequential schematic illustrations of how a larger log would be split by the log splitting head in three passes.
Figure 11B:
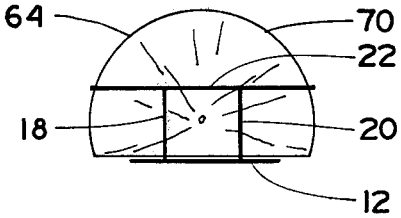
Figure 11C:
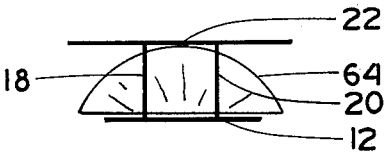
Figure 12A:
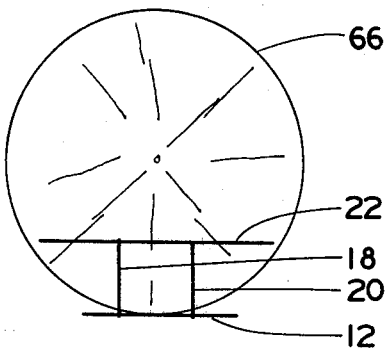
FIGS. 12A, B, C, D, and E are sequential schematic illustrations of how a larger log would be split by the log splitting head in five passes.
Figure 12B:
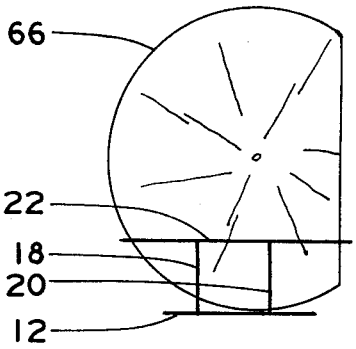
Figure 12C:
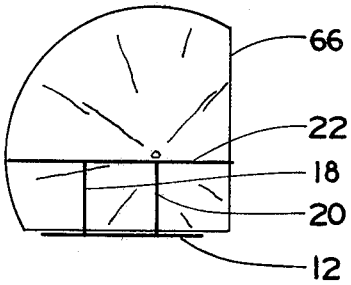
Figure 12D:
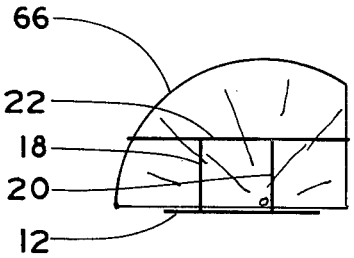
Figure 12E:
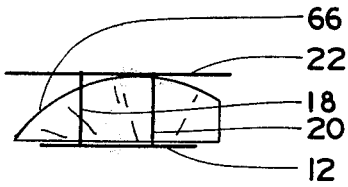

FIG. 8 shows a small log 56 placed against one of the vertical cutting plates 18. Such a log will only need one pass through the cutting head to be adequately split into two identical sections. A slightly larger log 58 shown in FIG. 9 can be split in one pass with the horizontal cutting plate 22 and one of the vertical cutting plates 18. A larger log 60 shown in FIGS. 10A and 10B can be split in two passes. The log 60 is first split in three sections as shown in FIG. 10A, and then the remaining upper portion 62 is split in half as shown in FIG. 10B. The sequential steps in splitting a larger log 64 and using all of the cutting plates is illustrated in FIGS. 11A, 11B, and 11C for a three pass operation. In the first pass, the lower portion of the log 64 is split into three smaller sections 67, 68, 69, which are ejected from the head. The remaining upper portion of the log 70 is brought back into position and split, and this procedure is repeated until the entire log 64 is split into small, approximately uniform sized sections. FIGS. 12A, 12B, 12C, 12D, and 12E illustrate the steps required to split a larger log 66 in five passes. After the first split is made, the log 66 is rotated 90° to the left for the remaining four passes.

It can be seen that the logs shown in FIGS. 8–12 will be split into approximately uniform sections, each no larger than the section which passes between the vertical cutting plates 18, 20 and beneath the horizontal cutting plate 22. The number of passes required through the log splitting head 10 will be determined by the diameter of the log being split as can be appreciated in FIGS. 8–12.

Although the invention has been described in detail above, it is only to be limited so far as is set forth in the accompanying claims.

I claim:

1. A log splitting head comprising:

A. a baseplate;

B. first and second vertical cutting plates opposed and spaced from each other and mounted to and perpendicular with the baseplate, each including a cutting edge;

C. a horizontal cutting plate mounted to and supported by the first and second cutting plates, and also including a cutting edge; and D. means for securing the baseplate to the main frame of a log splitting machine.

2. The log splitting head of claim 1 wherein the horizontal cutting edge leads the vertical cutting edges.

3. The log splitting head of claim 1 wherein the baseplate has a beveled edge.

4. The log splitting head of claim 1 wherein the horizontal cutting plate slopes upward and away from its cutting edge.

5. The log splitting head of claims 1, 2, 3, or 4 wherein the distance between the vertical cutting plates increases as the distance from their cutting edges increases.

6. The log splitting head of claim 5 wherein the means for securing the baseplate to the main frame of a log splitting machine includes a pair of spaced and opposed support plates mounted beneath the baseplate and pin means adapted to pass through the support plates and beneath the main frame.

7. The log splitting head of claim 6 wherein the horizontal cutting plate is detachably mounted to the vertical cutting plates.

8. In combination, a log splitting machine and a log splitting head mounted to the main frame of the log splitting machine, said log splitting head comprising:

A. a baseplate,

B. first and second vertical cutting plates opposed and spaced from each other and mounted to and perpendicular with the baseplate, each including a cutting edge;

C. a horizontal cutting plate mounted to and supported by the first and second cutting plates, and also including a cutting edge; and D. means for securing the baseplate to the main frame of the log splitting machine.

9. The combination of claim 8 wherein the horizontal cutting edge leads the vertical cutting edges.

10. The combination of claim 8 wherein the baseplate has a beveled edge.

11. The combination of claim 8 wherein the horizontal cutting plate slopes upward and away from its cutting edge.

12. The combination of claims 8, 9, 10 or 11 wherein the distance between the vertical cutting plates increases as the distance from their cutting edges increases.

13. The combination of claim 12 wherein the means for securing the baseplate to the main frame of the log splitting machine includes a pair of spaced and opposed support plates mounted beneath the baseplate and pin means which passes through the support plates and beneath the main frame, and is secured to the support plates.

14. The combination of claim 13 wherein the horizontal cutting plate is detachably mounted to the vertical cutting plates.

15. The combination of claim 14 further including a thrust plate mounted to the main frame immediately behind and adjacent the baseplate.

16. A log splitting head comprising:

A. a baseplate including a beveled edge;

B. first and second vertical cutting plates opposed and spaced from each other and mounted to and perpendicular with the baseplate, each including a cutting edge, wherein the distance between the vertical cutting plates increases as the distance from their cutting edges increases, C. a horizontal cutting plate mounted to and supported by the vertical cutting plates, and also including a cutting edge, wherein the horizontal cutting edge leads the vertical cutting edges and the horizontal cutting plate slopes upward and away from its cutting edge, and D. a pair of spaced and opposed support plates mounted beneath the baseplate and pin means adapted to pass through the support plates and beneath the main frame of a log splitting machine.

* * * * *